US008544584B2

(12) United States Patent
Takeda et al.

(10) Patent No.: US 8,544,584 B2
(45) Date of Patent: Oct. 1, 2013

(54) CONSTRUCTION VEHICLE

(75) Inventors: Takuya Takeda, Komatsu (JP); Shingo Hidaka, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/582,890

(22) PCT Filed: Dec. 15, 2011

(86) PCT No.: PCT/JP2011/079068

§ 371 (c)(1),
(2), (4) Date: Sep. 5, 2012

(87) PCT Pub. No.: WO2012/086519

PCT Pub. Date: Jun. 28, 2012

(65) Prior Publication Data

US 2012/0325569 A1 Dec. 27, 2012

(30) Foreign Application Priority Data

Dec. 24, 2010 (JP) ..... 2010-286972

(51) Int. Cl.
*B60K 11/00* (2006.01)

(52) U.S. Cl.
USPC ..... 180/68.1; 180/68.2; 180/68.3; 180/68.4; 165/41; 165/42; 165/67

(58) Field of Classification Search
USPC ..... 180/68.1–68.4, 68.6, 69.24; 165/41, 165/42, 67, 149; 292/338, DIG. 15; 217/60 C; 16/343, 345, 347; 248/292.14, 688, 222.41
See application file for complete search history.

(56) References Cited

U.S. PATENT DOCUMENTS 790,483 A * 5/1905 Demartini ..... 217/60 C
1,119,892 A * 12/1914 Socin ..... 217/60 D (Continued)

FOREIGN PATENT DOCUMENTS

JP 11-81960 A 3/1999
JP 2001-12244 A 1/2001

(Continued)

OTHER PUBLICATIONS

Translation of International Search Report for PCT/JP2011/079068.*

(Continued)

*Primary Examiner* — John R Olszewski
*Assistant Examiner* — Steve Clemmons
(74) *Attorney, Agent, or Firm* — Global IP Counselors, LLP

(57) ABSTRACT

A construction vehicle includes a cooling device. The cooling device includes a radiator disposed on a vehicle body frame, an oil cooler disposed adjacent to the radiator with a rear surface side thereof being arranged to face in roughly parallel to a lower part of a front surface of the radiator, and an opening/closing mechanism including a rotary shaft. The rotary shaft is obliquely disposed with a top end portion thereof being arranged closer to the front surface of the radiator than a bottom end portion thereof is. The opening/closing mechanism is configured to pivot the oil cooler about the rotary shaft and simultaneously move the oil cooler with respect to the radiator. Either a counterweight mounted on a rear part of the vehicle body frame or a part of the vehicle body frame is disposed on a line horizontally extended from a bottom end portion of the oil cooler.

12 Claims, 12 Drawing Sheets

(56) References Cited

U.S. PATENT DOCUMENTS

| | | | | |
|---|---|---|---|---|
| 2,197,286 | A * | 4/1940 | Zieman | 16/347 |
| 2,551,415 | A * | 5/1951 | Calling | 217/60 C |
| 3,297,080 | A * | 1/1967 | Williams et al. | 165/77 |
| 3,337,253 | A * | 8/1967 | Laukzemis | 292/268 |
| 3,743,045 | A * | 7/1973 | Hansen | 180/69.24 |
| 4,611,680 | A * | 9/1986 | Redenbarger et al. | 180/69.24 |
| 4,696,361 | A * | 9/1987 | Clark et al. | 180/68.4 |
| 5,046,550 | A * | 9/1991 | Boll et al. | 165/41 |
| 5,681,069 | A * | 10/1997 | Gaylord et al. | 292/338 |
| 6,105,660 | A * | 8/2000 | Knurr | 165/41 |
| 6,176,040 | B1 * | 1/2001 | Sugihara | 49/394 |
| 6,880,656 | B2 * | 4/2005 | Pfusterschmid et al. | 180/68.4 |
| 6,907,916 | B2 * | 6/2005 | Koyama | 165/67 |
| 7,128,178 | B1 * | 10/2006 | Heinle et al. | 180/68.4 |
| 2003/0168269 | A1 * | 9/2003 | Pfusterschmid et al. | 180/68.4 |
| 2006/0213640 | A1 * | 9/2006 | Matsuoka et al. | 165/67 |
| 2007/0246278 | A1 * | 10/2007 | Honzek et al. | 180/68.4 |
| 2008/0078525 | A1 * | 4/2008 | Adamson et al. | 165/44 |
| 2008/0283214 | A1 * | 11/2008 | Starkey et al. | 165/41 |
| 2009/0038775 | A1 * | 2/2009 | Leconte | 165/67 |

FOREIGN PATENT DOCUMENTS

| | | | |
|---|---|---|---|
| JP | 2001-41043 | A | 2/2001 |
| JP | 2001-248184 | A | 9/2001 |
| JP | 2004-278379 | A | 10/2004 |
| JP | 2009-113744 | A | 5/2009 |
| JP | 2012-1996 | A | 1/2012 |

OTHER PUBLICATIONS

International Search Report of corresponding PCT Application No. PCT/JP2011/079068.

* cited by examiner (a)

(b)

(a)

(b)

CONSTRUCTION VEHICLE

CROSS-REFERENCE TO RELATED APPLICATIONS

This application claims priority to Japanese Patent Application No. 2010-286972 filed on Dec. 24, 2010, the disclosure of which is hereby incorporated herein by reference in its entirety.

TECHNICAL HELD

The present invention relates to an opening/closing structure of a heat exchanger mounted on a construction vehicle such as a wheel loader.

BACKGROUND ART

In recent years, construction vehicles such as wheel loaders, hydraulic excavators, bulldozers and etc. are embedded with a variety of heat exchangers (e.g., a radiator for cooling an engine, an oil cooler for cooling oil, an after-cooler for cooling inhaled air and etc.) positioned closer to each other on the vehicle bodies thereof.

For example, Japan-Laid Open Patent Application Publication No. 2001-41043 (published on Feb. 13, 2001) describes a mechanism for opening/closing an oil cooler with respect to a radiator through a hinge where the oil cooler is obliquely disposed with respect to the front surface of the radiator at an angle $\alpha$ in order to easily clean a variety of heat exchangers (coolers).

SUMMARY

However, the aforementioned well-known construction vehicle has the following drawbacks.

Specifically, according to the arrangement of the coolers of the construction machine described in the aforementioned publication, the surface of the oil cooler is obliquely disposed with respect to the surface of the radiator disposed along a roughly vertical direction. Therefore, the arrangement may degrade the cooling efficiency of either the radiator or the oil cooler disposed downstream in a flow path of cooling wind.

It is herein assumed that the oil cooler and the radiator are disposed roughly in parallel to each other while the front surfaces thereof are faced in order to enhance the cooling efficiency in the structure described in the aforementioned publication. In this case, the oil cooler is configured to be moved roughly along the horizontal direction when being opened and closed with respect to the radiator in executing maintenance and etc. Therefore, the oil cooler may herein interfere with a counterweight, a frame and etc.

It is an object of the present invention to provide a construction vehicle for avoiding degradation in cooling efficiency of a heat exchanger, and simultaneously, for avoiding interference between an oil cooler and the other members even in opening/closing the oil cooler to execute maintenance and etc.

A construction vehicle according to a first aspect of the present invention includes a vehicle body frame, a power compartment, a cooling compartment, a cooling device and a cooling fan. The power compartment accommodates an engine mounted on the vehicle body frame. The cooling compartment is disposed rearwards of the power compartment. The cooling device is disposed within the cooling compartment and includes a plurality of heat exchangers. The cooling fan is disposed within the cooling compartment and is configured to form a cooling wind flow path for inhaling outdoor air and directing the inhaled outdoor air towards the cooling device. Further, the cooling device includes a radiator, an oil cooler and an opening/closing mechanism. The radiator is disposed on the vehicle body frame along a roughly vertical direction. The oil cooler is disposed adjacent to the radiator for arranging a rear surface side thereof to be faced in roughly parallel to a lower part of a front surface of the radiator. The opening/closing mechanism includes a rotary shaft. The rotary shaft is obliquely disposed for arranging a top end portion thereof closer to the front surface of the radiator than a bottom end portion thereof is. The opening/closing mechanism is configured to pivot the oil cooler about the rotary shaft and simultaneously move the oil cooler with respect to the radiator. Yet further, either a counterweight mounted on a rear part of the vehicle body frame or a part of the vehicle body frame is disposed on a line horizontally extended from a bottom end portion of the oil cooler.

In this case, in the construction vehicle such as a wheel loader embedded with the heat exchangers such as the radiator, the oil cooler and etc., the radiator and the oil cooler are disposed roughly in parallel to each other, and simultaneously, the opening/closing mechanism for opening/closing the oil cooler with respect to the radiator in executing maintenance etc. for the radiator and etc. is configured to move the oil cooler about the rotary shaft obliquely disposed with respect to the front surface of the radiator.

The aforementioned front surface of the radiator herein refers to the upstream side surface in the flow path of the cooling wind passing through the radiator and the oil cooler, and simultaneously, refers to the surface to be exposed in rotating and moving the oil cooler in executing maintenance and etc.

Further, the oil cooler is required to exchange a large amount of heat. Therefore, the oil cooler is preferably disposed for enhancing efficiency in heat exchange as much as possible and for preventing an adverse effect on the other heat exchangers as much as possible in an unexpected oil leakage. Therefore, in terms of the heat exchanging efficiency of the oil cooler, the oil cooler is preferably disposed roughly in parallel to the radiator while being disposed upstream of the radiator in the flow path of the cooling wind. Yet further, in addition to the aforementioned arrangement, the installation position of the oil cooler is preferably as low as possible in consideration of an oil leakage.

On the other hand, when the oil cooler is disposed while being faced to the lower part of the front surface of the radiator in order to solve the aforementioned drawbacks of the heat exchanging efficiency of the oil cooler, an oil leakage and etc., an end of the counterweight, a part of the vehicle body frame and etc. may interfere with the moving trajectory of the oil cooler in opening/closing the oil cooler in executing maintenance and etc. of the radiator.

According to the construction vehicle of the first aspect of the present invention, the oil cooler is disposed while being faced to the lower part of the front surface of the radiator, and simultaneously, the rotary shaft of the opening/closing mechanism for opening/closing the oil cooler is obliquely disposed with respect to the front surface of the radiator in order to solve all the aforementioned three drawbacks of the heat exchanging efficiency of the oil cooler, an oil leakage and opening/closing in executing maintenance.

More specifically, the aforementioned rotary shaft is obliquely disposed with respect to the radiator while the top end thereof is disposed closer to the front surface of the radiator than the bottom end thereof is.

Accordingly, even when the oil cooler is disposed adjacent to and roughly in parallel to the lower part of the front surface of the radiator in consideration of the heat-transfer efficiency of the oil cooler, an oil leakage and etc., the oil cooler configured to rotate about the rotary shaft is gradually rotated and moved while being raised vertically upwards in proportion to increase in the opening angle. Therefore, even when opened/closed in executing maintenance and etc., the oil cooler can be smoothly opened/closed without interfering with the counterweight or a part of the vehicle body frame.

As a result, a work can be executed while the heat exchanging efficiency is enhanced and an adverse effect is minimized in occurrence of an oil leakage, and simultaneously; while the oil cooler is opened to a position at a required opening angle even in executing maintenance.

Further in the construction vehicle, either the counter weight or a part of the vehicle body frame is herein disposed at a horizontal level of the bottom end portion of the oil cooler that is disposed while being faced to the lower part of the front surface of the radiator.

When the oil cooler is herein opened/closed along the horizontal level as it is, the bottom and portion of the oil cooler interferers with the counterweight or a part of the vehicle body frame.

According to the construction vehicle of the first aspect of the present invention, the oil cooler is configured to be rotated and moved about the aforementioned rotary shaft obliquely disposed with respect to the front surface of the radiator.

Accordingly, even when the oil cooler is disposed adjacent to and roughly in parallel to the lower part of the front surface of the radiator, the oil cooler can be opened/closed without interfering with the counterweight or etc. positioned at the same height level in the opening/closing side of the oil cooler.

A construction vehicle according to a second aspect of the present invention relates to the construction vehicle according to the first aspect of the present invention. In the construction vehicle, the oil cooler and the radiator are disposed in this order from a vehicle body rear end side along a back-and-forth direction of the vehicle body frame.

According to the construction vehicle of the second aspect of the present invention, the aforementioned oil cooler and radiator are disposed in this order from the vehicle body rear end side along the back-and-forth direction of the construction vehicle.

With the structure, when the present invention is applied to a construction vehicle such as a wheel loader, it is possible to provide a construction vehicle fir enhancing heat exchanging efficiency, minimizing an adverse effect due to an oil leakage, and smoothly opening/closing the oil cooler in executing maintenance and etc.

A construction vehicle according to a third aspect of the present invention relates to the construction vehicle according to one of the first and second aspects of the present invention in the construction vehicle, the opening/closing mechanism further includes a support bracket, a main body frame and an attachment part. The support bracket supports the oil cooler. The main body frame receives the oil cooler attached thereto. The attachment part couples the main body frame and the support bracket through the rotary shaft.

According to the construction vehicle of the third aspect of the present invention, the opening/closing mechanism for opening/closing the oil cooler with respect to the radiator includes: the support bracket supporting the oil cooler; the vehicle body frame receiving the oil cooler attached thereto; the rotary shaft for rotating and moving the vehicle body frame together with the oil cooler with respect to the radiator; and the attachment part for fixing the vehicle body frame and the rotary shaft to the vehicle body side.

Thus, with the structure of fixing the attachment part of the opening/closing mechanism to the vehicle body side, it is possible to rotate and move the oil cooler fixed to the vehicle body frame about the rotary shaft with respect to the radiator.

A construction vehicle according to a fourth aspect of the present invention relates to the construction vehicle according to the third aspect of the present invention. In the construction vehicle, the opening/closing mechanism further includes a plate member, a groove part and a rod-shaped member. The plate member is fixed to the main body frame while being disposed in parallel to the roughly vertical direction. The groove part is formed in the plate member. The groove part includes a roughly horizontal portion and a guide groove extended from the roughly horizontal portion in a roughly vertically downward direction. The rod-shaped member has a first end portion. The first end portion is configured to be moved along a shape of the guide groove while being inserted into the groove part. Further, the first end portion is configured to fall into and held by the guide groove when the oil cooler is opened to a position at a (predetermined angle.

According to the construction vehicle of the fourth aspect of the present invention, a lock mechanism for restricting the opening angle in opening/closing the oil cooler is formed by inserting one end (i.e., the first end portion) of the rod-shaped member into the groove part formed in the plate member fixed to the vehicle body frame and by allowing the first end portion to fall into the vertically downward guide groove forming a part of the groove part when the oil cooler is opened to a position at a predetermined opening angle.

Now, in opening/closing the oil cooler by rotating and moving it about the rotary shaft obliquely disposed with respect to the aforementioned radiator, the position of the center of mass of the oil cooler is moved towards the opening side of the oil cooler in accordance with variation in the opening angle when the opening angle becomes a predetermined opening angle or greater. Accordingly, a state is produced that the oil cooler is spontaneously further opened by the weight thereof when an operator releases his/her hold of the oil cooler.

Accordingly, in gradually opening the oil cooler about the aforementioned rotary shaft, the first end portion of the rod-shaped member falls into the vertical-downwardly formed guide groove of the groove part when the oil cooler is opened to a position at a minimum opening angle required for executing maintenance and etc. of the radiator. The oil cooler can be thereby locked from being further opened from the position.

In closing the oil cooler, on the other hand, locking of the oil cooler by the opening/closing mechanism can be easily released only by lifting up the first end portion fallen into the vertically downward guide groove with an operator's hand.

As a result, it is possible to efficiently execute a maintenance work for the radiator, the oil cooler and etc. in a stable state.

A construction vehicle according to a fifth aspect of the present invention relates to the construction vehicle according to the fourth aspect of the present invention. In the construction vehicle, the opening/closing mechanism further includes a circular hole portion. The circular hole portion allows a second end portion of the rod-shaped member to be pivotably inserted therein through a predetermined clearance. The second end portion is formed oppositely to the first end portion of the rod-shaped member. Further, the circular hole portion is roughly vertically opened in a support portion attached to the support bracket.

According to the construction vehicle of the fifth aspect of the present invention, the circular hole portion is provided for allowing the rotary shaft side end (i.e., the second end portion) of the rod-shaped member to be inserted therein through a predetermined clearance.

The circular hole portion herein preferably includes a hole portion having an inner diameter slightly greater than the outer diameter of the second end portion while being disposed on a vehicle body side or etc.

With the structure, the rod-shaped member can be moved along the roughly horizontal direction in accordance with the action of the oil cooler in opening/closing the oil cooler. Further, the rod-shaped member can be also moved in the vertical direction by a predetermined clearance of the circular hole portion when the end (i.e., the first end portion) of the rod-shaped member falls into the vertically downward portion of the guide groove.

According to the construction vehicle of the present invention, it is possible to avoid degradation in cooling efficiency in the heat exchangers, and simultaneously, avoid interference between the oil cooler and the other members even in opening/closing the oil cooler for executing maintenance and etc.

DESCRIPTION OF THE EMBODIMENTS

A wheel loader (construction vehicle) 10 embedded with an opening/closing structure for a heat exchanger according to an exemplary embodiment of the present invention will be hereinafter explained with reference to FIGS. 1 to 12(*h*).

Structure of Wheel Loader 10

Figure 1:
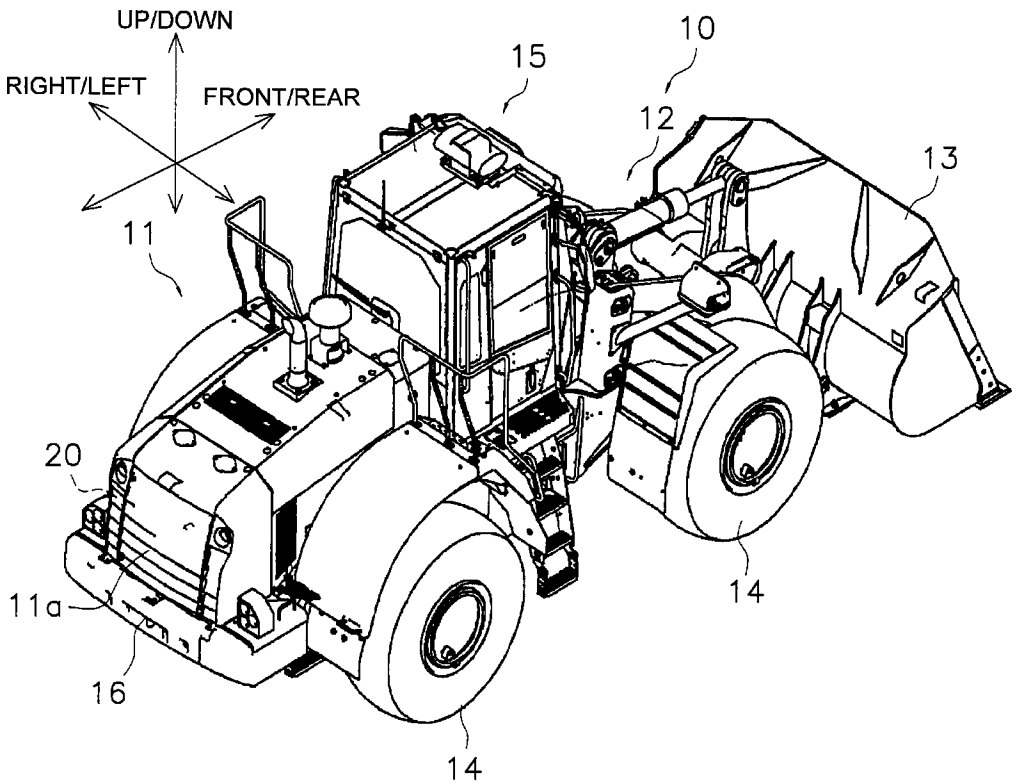
FIG. 1 is a perspective view of the structure of a wheel loader according to an exemplary embodiment of the present invention.

As illustrated in FIG. 1, the wheel loader 10 according to the present exemplary embodiment includes a vehicle body 11, a lift arm 12, a bucket 13, four tires 14, a cab 15 and a counterweight 16. The lift arm 12 is mounted to the front part of the vehicle body 11. The bucket 13 is attached to a tip of the lift arm 12. The tires 14 are configured to be rotated while supporting the vehicle body 11. The cab 15 is mounted on the top part of the vehicle body 11. The counterweight 16 is attached to the rear end of the vehicle body 11.

An engine 17 (see FIG. 5), a cooling device 20 and etc. are mounted on a vehicle body frame 45 (see FIG. 5) of the vehicle body 11. The engine 17 is accommodated in a power compartment 41. On the other hand, the cooling device 20 is accommodated in a cooling compartment 42 disposed rearwards of the power compartment 41. The power compartment 41 and the cooling compartment 42 are divided by a partition 43. It should be noted that the structure of the cooling device 20 will be explained below in detail.

The lift arm 12 is an arm member for lifting up the bucket 13 attached to the tip thereof. The lift arm 12 is configured to be driven by a lift cylinder attached thereto.

The bucket 13 is attached to the tip of the lift arm 12. The bucket 13 is configured to be dumped and tilted by a bucket cylinder.

The cab 15 forms an operating room for an operator, which is structured by the combination of a plurality of steel pipes and steel plates. The cab 15 is disposed slightly forwards of the center part of the vehicle body 11.

The counterweight 16 is disposed on the rear end of the vehicle body 11 while being disposed under a grill 11*a* that can be opened and closed for keeping vehicle body balance in executing a work of scooping earth, sand and etc. with the bucket 13.

Structure of Vehicle Body Rear Part of Wheel Loader 10

Figure 2:
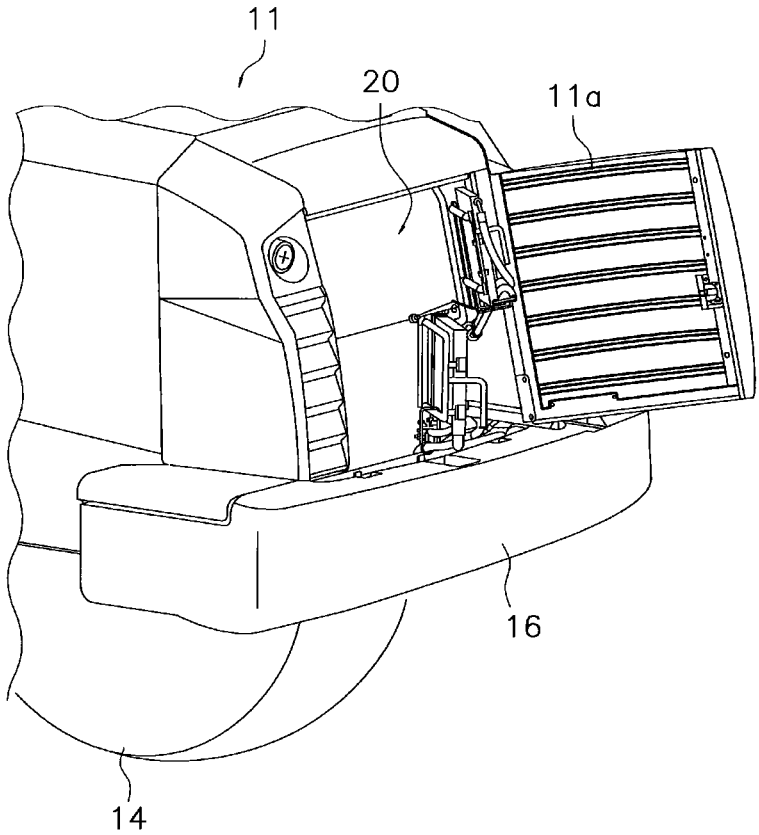
FIG. 2 is a perspective view of an opened state of a grill mounted to the rear end of a vehicle body of the wheel loader of FIG. 1.

As illustrated in FIG. 2, the wheel loader 10 of the present exemplary embodiment includes the grill ha and the cooling device 20. The grill ha is disposed on the rear end of the vehicle body 11 in an openable/closable state. The cooling device 20 is positioned to be exposed to the outside in opening the grill 11*a*.

The grill 11*a* includes an air inlet for inhaling air into the inside of the vehicle body 11. A cooling fan 21, included in the cooling device 20, inhales cooling wind into the inside the vehicle body 11 through the air inlet.

Structure of Cooling Device 20

Figure 3:
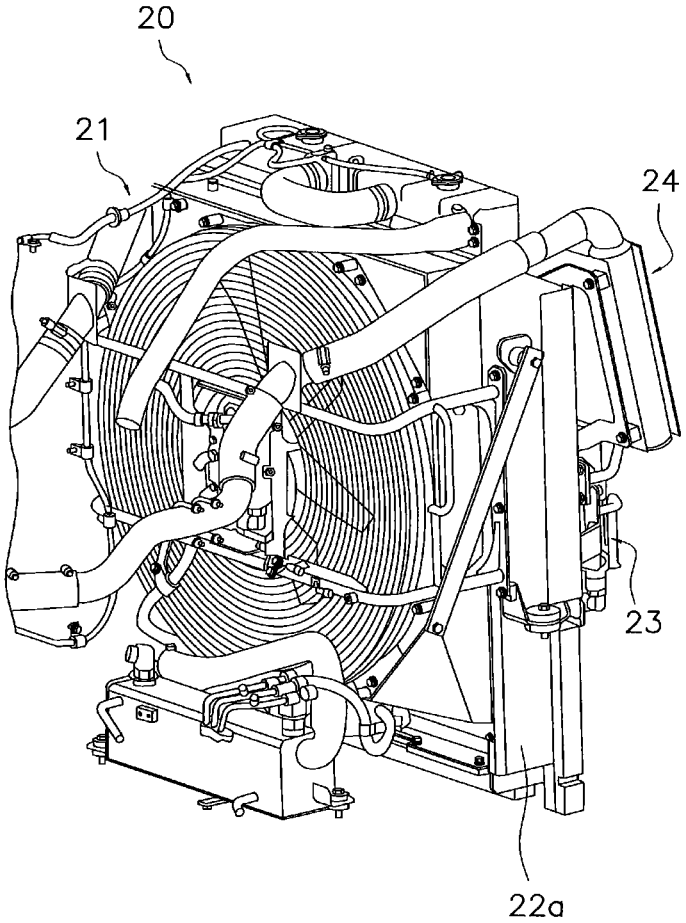
FIG. 3 is a rear perspective view illustrating the structure of a cooling device mounted within the vehicle body of the wheel loader illustrated in FIG. 1.

The cooling device 20 includes a plurality of heat exchangers and the cooling fan 21 (see FIG. 3). The heat exchangers are configured to cool down the engine 17 and operating oil. The cooling fan 21 is configured to form air stream for blowing cooling wind towards the heat exchangers. Further, a radiator 22, an oil cooler 23, an after-cooler 24, an air conditioner condenser 25 and a fuel cooler 26 are mounted along the back-and-forth direction of the vehicle body 11 as the plural heat exchangers included in the cooling device 20.

It should be noted in the following explanation that the front surface refers to the surface of the cooling device 20 exposed to the outside while the grill 11*a* is opened, in other words, the front surface of the cooling device 20 seen from the rear end side of the vehicle body lit and simultaneously; the upstream side surface in the cooling wind flow path, while the rear surface refers to the surface oppositely to the front surface.

As illustrated in FIG. 3, the cooling fan 21 is disposed on the rearmost position in the cooling device 20 when seen from the rear end of the vehicle body 11. The cooling fan 21 is configured to be driven and rotated by an electric motor or a hydraulic motor (not illustrated in the figures) for forming an air stream whereby cooling wind can be inhaled into the vehicle body 11 through the grill 11*a*. It should be noted that the cooling wind, formed by the cooling fan 21, is inhaled into the vehicle body 11 through the grill 11*a* (see an arrow A in FIG. 5) and is then discharged to the outside from the top side and the lateral sides of the vehicle body 11 (see arrows A' in FIG. 5).

Figure 4:
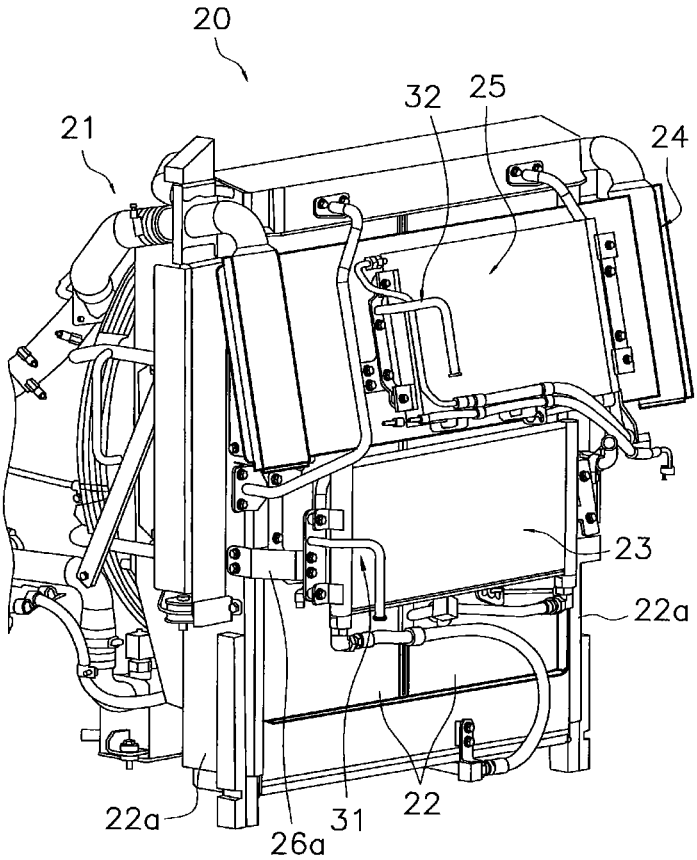
FIG. 4 is a front perspective view of the cooling device illustrated in FIG. 3.
Figure 5:
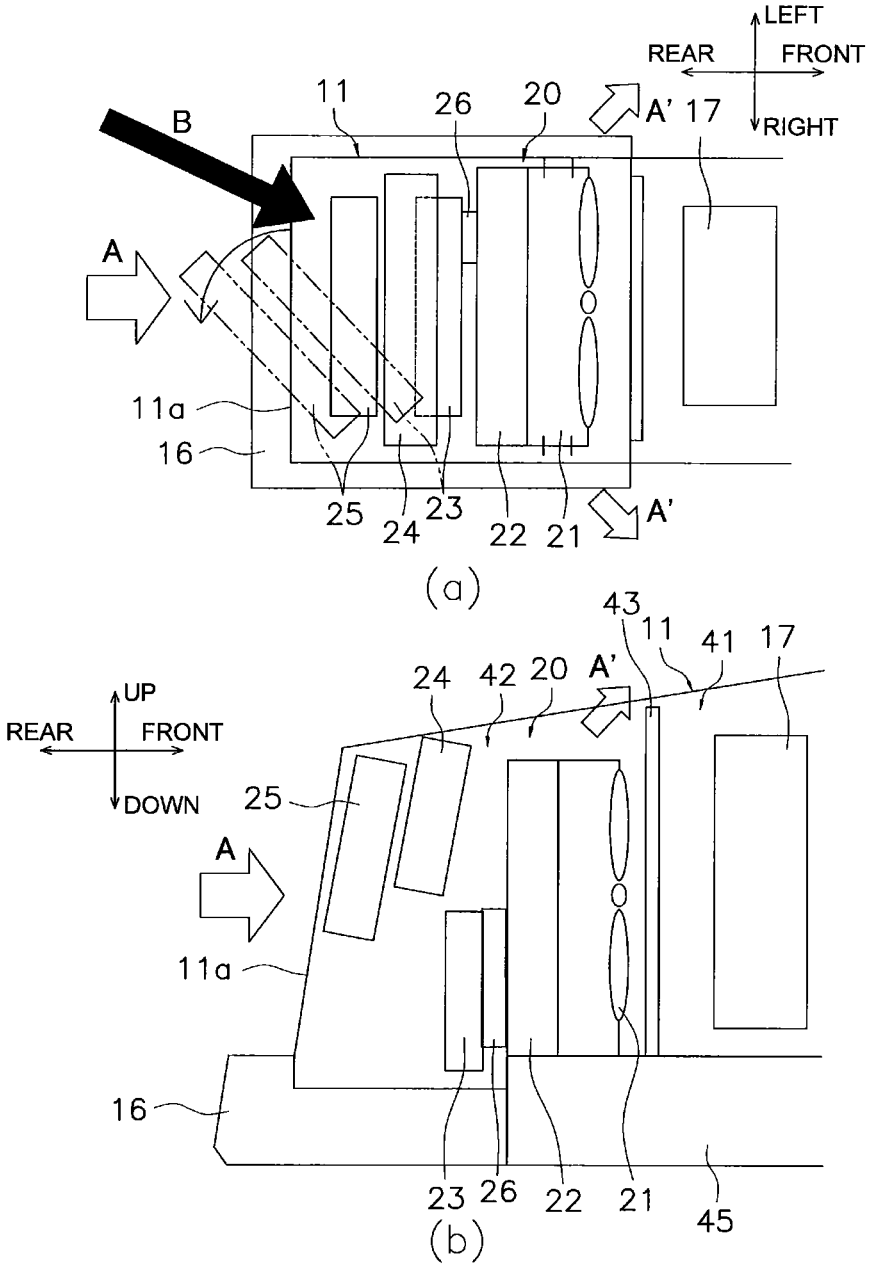
FIG. 5 includes: a cross-sectional plan view (a) illustrating a schematic layout of the cooling device illustrated in FIG. 3; and a cross-sectional side view (b) of the schematic layout of the cooling device illustrated in FIG. 3.

The radiator 22 is a heat exchanger configured to exchange heat between the cooling water flowing through the engine 17 and the cooling wind. As illustrated in FIG. 4, the radiator 22 is disposed adjacent to the cooling fan 21 for covering the front surface side of the cooling fan 21 (i.e., the upstream side in the cooling wind flow path). As illustrated in FIG. 4, the radiator 22 stands upright while the right and left ends thereof are supported by a support frame 22. As illustrated in FIGS. 5(*a*) and 5(*b*), the radiator 22 is disposed in a most downstream position in the cooling wind flow path with respect to the other heat exchangers (i.e., the oil cooler 23, the after-cooler 24, the air conditioner condenser 25, the fuel cooler 26 and etc.). As illustrated in FIG. 5(*b*), the radiator 22 stands upright along a roughly vertical direction together with the cooling fan 21. Due to the arrangement of the radiator 22 disposed in the most downstream position in the cooling wind flow path, the cooling wind, having passed through the air conditioner condenser 25 and the after-cooler 24, passes through the upper part of the radiator 22, while the cooling wind, having passed the oil cooler 23 and the fuel cooler 26, passes through the lower part of the radiator 22.

The oil cooler 23 is a heat exchanger configured to cool down the operating oil. As illustrated in FIG. 4, the oil cooler 23 is attached to a bracket 26*a* while covering the front surface of the lower part of the radiator 22. A pipe 23*b* is connected to the bottom end surface of the oil cooler 23 through a connection portion 23*a* (see FIGS. 6(*a*) and 6(*b*)). As illustrated in FIG. 5(*a*), an opening/closing mechanism 31 illustrated in FIG. 4 causes the oil cooler 23, together with the aforementioned connection portion 23*a* and the pipe 23*b*, to pivot about a transverse end of the oil cooler 23 with respect to the radiator 22. As illustrated in FIG. 5(*b*), the oil cooler 23 stands upright on the vehicle body 11 while being arranged roughly in parallel to the radiator 22 standing upright along a roughly vertical direction. Further, as illustrated in FIG. 5(*b*), the counterweight 16 is disposed on a horizontally extended line on the front surface side of the oil cooler 23. Therefore, when the oil cooler 23 is horizontally opened and closed as it is, a positional relation is produced that the oil cooler 23 interferes with the bottom end portion of the counterweight 16 (i.e., the connection portion 23*a*, the pipe 23*b*, etc. (see FIG. 6)). It should be noted that detailed explanation will be described below for the structure of the opening/closing mechanism 31 configured to pivot the oil cooler 23 without causing interference of the oil cooler 23 with the counterweight 16.

To exchange a large amount of heat, the oil cooler 23 is herein preferably disposed on the most upstream side in the cooling wind flow path as much as possible. Further, the mounted surface of the oil cooler 23 is preferably positioned as low as possible for minimizing impact on the other heat exchangers and etc. when a trouble such as oil leakage occurs. In the present exemplary embodiment, it is possible to directly blow the cooling wind inhaled from the outdoor air towards the oil cooler 23 due to the arrangement of the oil cooler 23 disposed on the front surface side of the radiator 22. Therefore, cooling efficiency in the cooling device 20 can be enhanced. Further, in the present exemplary embodiment, the oil cooler 23 is directly disposed on the mounted surface of the vehicle body 11. Therefore, the oil cooler 23 is disposed lower than the other heat exchangers (i.e., the after-cooler 24, the air conditioner condenser 25, etc.). Accordingly, it is possible to minimize adverse effect on the other heat exchangers even when oil leakage from the oil cooler 23 occurs.

The after-cooler 24 is a heat exchanger disposed for lowering the intake temperature of the engine 17. As illustrated in FIG. 4, the after-cooler 24 is disposed while covering the front surface of the upper part of the radiator 22. As illustrated in FIG. 5(*b*), the after-cooler 24 as well as the air conditioner condenser 25 is obliquely attached with respect to the radiator 22 and the oil cooler 23, which stand upright along a roughly vertical direction.

It should be noted that the after-cooler 24 is disposed while a predetermined clearance is reliably produced between the bottom end portion of the after-cooler 24 and the top end portion of the oil cooler 23. Therefore, alter the cooling wind entered the vehicle body 11 through the grill 11*a*, a part of the cooling wind, which entered the vehicle body 11 through the lower part of the grill 11*a* and passed through the aforementioned predetermined clearance, joins to another part of the cooling wind that passed through the air conditioner condenser 25 and the after-cooler 24. Accordingly, the joined part of the cooling wind passes through the upper part of the radiator 22. Accordingly, it is possible to keep the cooling wind passing through the upper part of the front surface of the radiator 22 at a lower temperature even when two heat exchanges (i.e., the after-cooler 24 and the air conditioner condenser 25) are disposed on the upper part of the front surface of the radiator 22.

The air conditioner condenser 25 is a heat exchanger configured to condense into liquid the coolant gas to be supplied to an air conditioner serving to comfortably condition the inside of the cab 15. As illustrated in FIG. 4, the air conditioner condenser 25 is disposed on the front surface side of the after-cooler 24 while being disposed on the forefront side in the cooling device 20. As illustrated in FIG. 5(*a*), an opening/closing mechanism 32 illustrated in FIG. 4 is configured to pivot the air conditioner condenser 25 about a width-directional end side of the air conditioner condenser 25 with respect to the after-cooler 24. As illustrated in FIG. 5(*b*), the air conditioner condenser 25 is disposed on the front surface side of the after-cooler 24 while being disposed roughly in parallel to and adjacent to the after-cooler 24. As described above, the air conditioner condenser 25 as well as the after-cooler 24 is obliquely disposed with respect to the vertical direction. As illustrated in FIG. 5(*b*), the slant angles of the after-cooler 24 and the air conditioner condenser 25 are herein set to be roughly the same as the slant angle of the grill 11*a*. Accordingly, it is possible to efficiently blow the air conditioner condenser 25 disposed on the forefront surface side in the cooling device 20 and the after-cooler 24 disposed on the rear surface side of the air conditioner condenser 25 with the cooling wind having passed through the grill 11*a*. It is thus possible to enhance cooling efficiency in the cooling device 20.

It should be noted that it is preferable to directly blow the air conditioner condenser 25 with the cooling wind inhaled through the outdoor air as much as possible for maintaining comfortableness within the cab 15. In view of this, in the present exemplary embodiment, the air conditioner condenser 25 is disposed on the forefront surface side in the cooling device 20 while being disposed roughly in parallel to the will 11*a*.

The fuel cooler 26 is a heat exchanger disposed for preventing increase in the temperature of the fuel to be supplied to the engine 17. As illustrated in FIG. 5(*a*), the fuel cooler 26 is disposed between the radiator 22 and the oil cooler 23 while being disposed in a position oppositely to the side of the oil cooler 23 as the pivot center. As illustrated in FIG. 4, the fuel cooler 26 is mounted to the support frame 22*a* for fixing the radiator 22.

Opening/Closing Mechanism 31 of Oil Cooler 23

Figure 6:
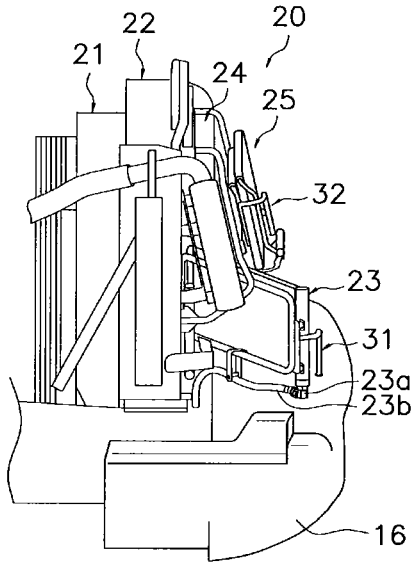
FIG. 6 includes: a side view (a) illustrating a state that an oil cooler included in the cooling device illustrated in FIG. 3 is opened to a position at an angle of 30 degrees; and a side view (b) illustrating a state that the oil cooler is opened to a position at a maximum opening angle.
Figure 6:
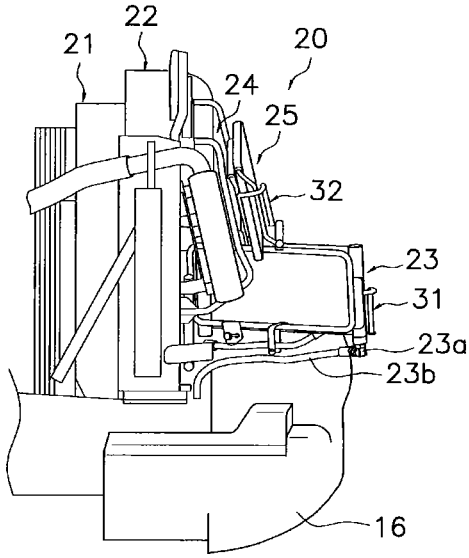

The opening/closing mechanism 31 configured to pivot the oil cooler 23 is disposed for reliably producing a space for executing maintenance of the radiator 22 disposed on the rear surface side of the oil cooler 23. As illustrated in FIGS. 6(*a*) and 6(*b*), the opening/closing mechanism 31 is configured to pivot the oil cooler 23 to a position at a predetermined opening angle about a pivot shaft 31*a* (see FIG. 7) disposed in the vicinity of the right end of the front surface of the oil cooler 23. It should be noted that FIG. 6(*a*) illustrates a state that the oil cooler 23 is opened to a position at an opening angle of roughly 30 degrees. FIG. 6(*h*) illustrates a state that the oil cooler 23 is opened to a position at the maximum opening angle of roughly 37 degree.

Figure 7:
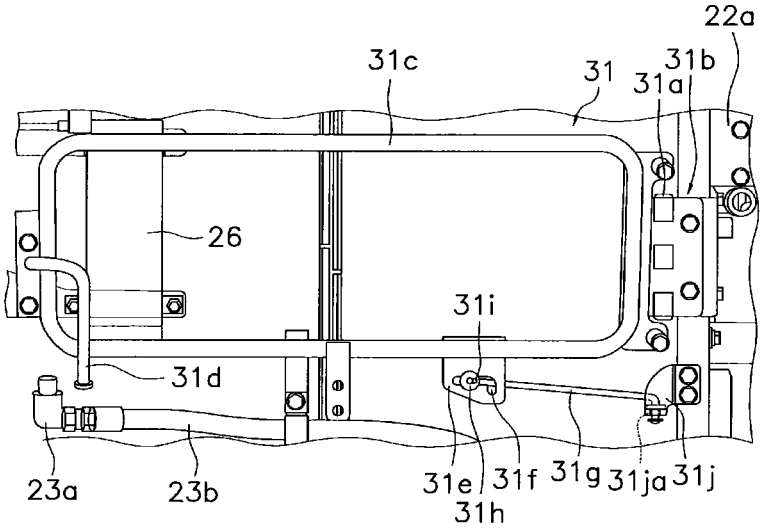
FIG. 7 is a front view of the structure of an opening/closing mechanism for pivoting the oil cooler included in the cooling device of FIG. 3.

As illustrated in FIG. 7, the opening/closing mechanism 31 includes a rotary shaft 31*a*, an attachment part 31*b*, a main body frame 31*c*, a handle 31*d*, a plate member 31*e*, a guide groove 31*f*, a rod-shaped member 31*g*, a washer 31*h*, a pin 31*i* and a support part 31*j*.

Figure 8:
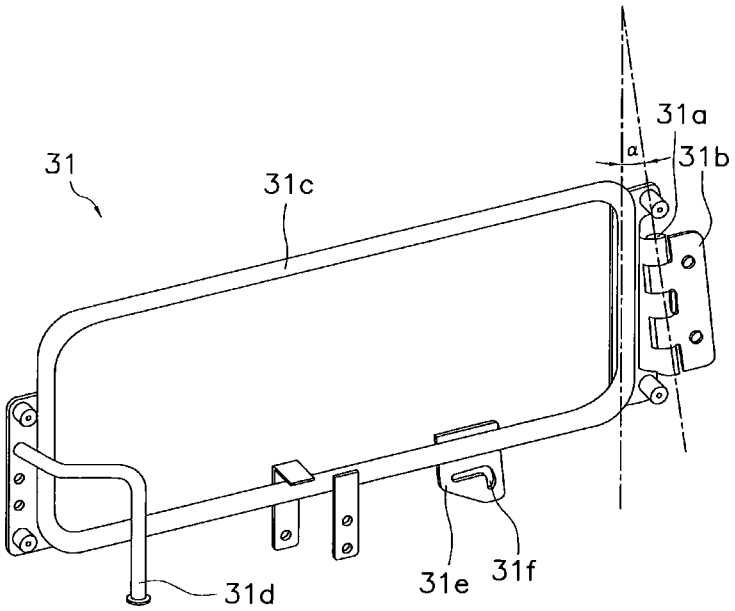
FIG. 8 is a perspective view of the structure of the opening/closing mechanism for pivoting the oil cooler included in the cooling device of FIG. 3.

The rotary shaft 31*a* serves as the pivot center in pivoting the oil cooler 23 and is disposed in the vicinity of the right end of the oil cooler 23. As illustrated in FIG. 8, the rotary shaft 31*a* is slanted only at an angle α with respect to the vertical direction in the back-and-forth direction of the vehicle body 11. Further, the slant direction of the rotary shaft 31*a* is arranged while being downwardly slanted to the rear side of the vehicle body 11, in other words, while distance from the rotary shaft 31*a* to the front surface of the radiator 22 is smaller in the top end of the rotary shaft 31*a* than in the bottom end of the rotary shaft 31*a*.

In the present exemplary embodiment, the pivot shaft 31*a* attached in a slanted state at the angle α makes it possible to move and raise the oil cooler 23 obliquely upwards in the process of gradually opening the oil cooler 23 as described below. Therefore, a maintenance work and etc. can be executed while the oil cooler 23 is pivoted to a position at a predetermined opening angle without making contact with the aforementioned counterweight 16 (see FIGS. 5, 6 and etc.) disposed on a line horizontally extended from the end of the oil cooler 23.

The attachment part 31*b* is a member for coupling the main body frame 31*c* and the support frame 22*a* of the radiator 22 through the pivot shaft 31*a*. The attachment part 31*b* is fixed to the support frame 22*a* by means of bolts.

The main body frame 31*c* is a roughly rectangular annular frame to be attached to the rear surface side of the oil cooler 23. The main body frame 31*c* is configured to pivot about the pivot shaft 31*a* together with the oil cooler 23. As illustrated in FIG. 8, the main body frame 31*c* is disposed along a roughly direction. Accordingly, the oil cooler 23 can be disposed along a roughly vertical direction together with the radiator 22.

The handle 31*d* is a part to be held in pivoting the oil cooler 23. The handle 31*d* is disposed on an end, oppositely to the pivot shaft 31*a* side, of the main body frame 31*c*.

Figure 9:
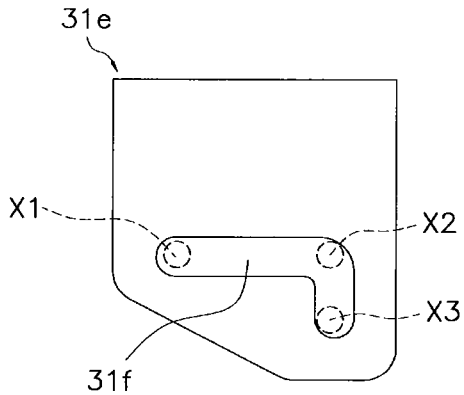
FIG. 9 includes: a component enlarged view (a) of a part of a plate member of the opening/closing mechanism of FIG. 8; and a perspective view (b) of a rod-shaped member of the opening/closing mechanism of FIG. 8.
Figure 9:
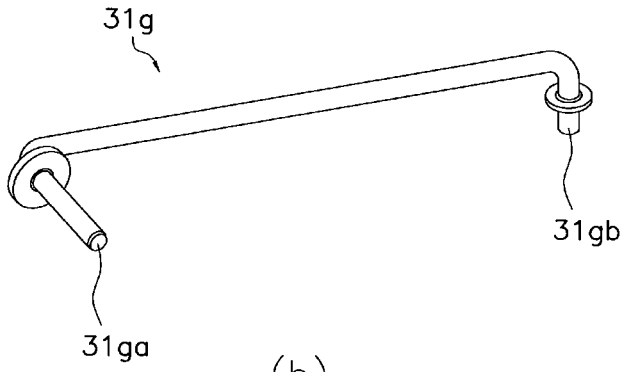

As illustrated in FIG. 8, the plate member 31*e* is disposed in a position slightly rightwards of the center part of the bottom side of the main body frame 31*c* having a roughly rectangular annular shape while being downwardly protruded therefrom. As illustrated in FIG. 9(*a*), the plate member 31*e* includes the guide groove 31*f* in the center part thereof.

As illustrated in FIG. 7, the guide groove 31*f* is a groove penetrating in the back-and-forth direction of the vehicle body 11 and allows a first end portion 31*ga* of the rod-shaped member 31*g* (see FIG. 9(*b*)) to be inserted and moved therein. As illustrated in FIG. 8, the guide groove 31*f* is formed in the plate member 31*e*. As illustrated in FIG. 9(*a*), the guide groove 31*f* includes a groove portion ranging from a point X1 to a point X2 along the horizontal direction and a groove portion ranging from the point X2 to a point X3 along the vertical direction. With the structure, in the process of opening the oil cooler 23, the first end portion 31*ga* of the rod-shaped member 31*g* is gradually moved within and along the guide groove 31*f*. When moved to the point X2, the first end portion 31*ga* of the rod-shaped member 31*g* downwardly falls due to gravity acting on the rod-shaped member 31*g* and is held at the point X3 within the groove. As a result, the oil cooler 23 can be restricted from pivoting at a desired maximum opening angle (roughly 37 degrees in this case).

As illustrated in FIG. 9(*b*), the rod-shaped member 31*g* includes the first end portion 31*ga* and a second end portion 31*gb*. The first end portion 31*ga* is configured to be moved along the guide groove 31*f* while the rod-shaped member 31*g* is pivoted about the second end portion 31*gb* as a pivot axis in conjunction with the pivot of the oil cooler 23. The first end portion 31*ga* is protruded along a roughly horizontal direction in the attached state and is inserted into the guide groove 31*f*. The second end portion 31*gb* is protruded roughly vertically downwards in the attached state. The second end portion 31*gb* functions as a pivot center of the rod-shaped member 31*g* while being supported in the support part 31*j*.

Figure 10:
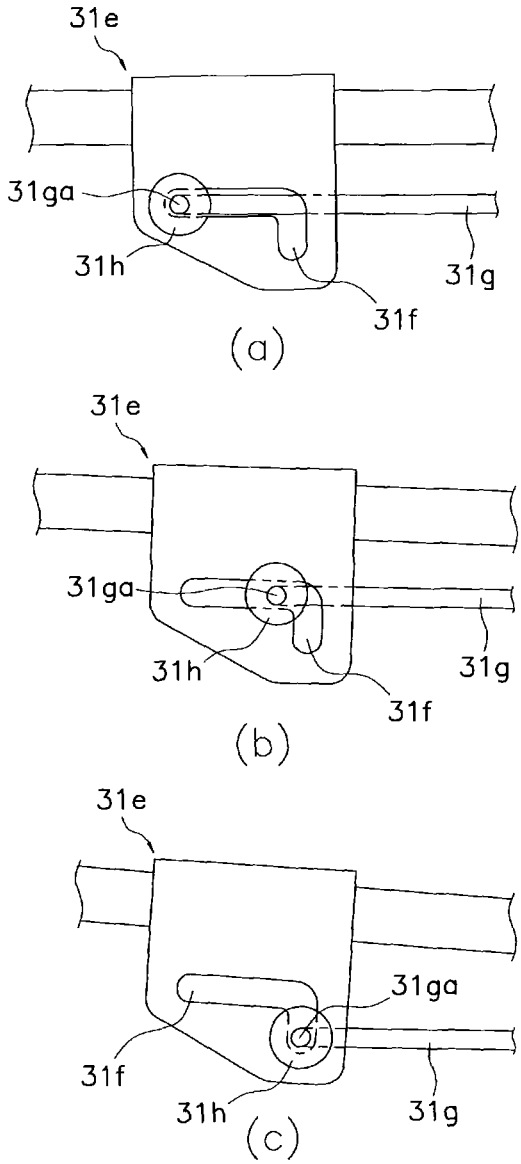
FIG. 10 includes front views (a) to (c) illustrating positional relations between a groove part formed in the plate member and an end portion of the rod-shaped member in gradually opening the oil cooler included in the cooling device of FIG. 3.

As illustrated in FIGS. 10(*a*) to 10(*c*), the washer 31*h* is attached to the tip of the first end portion 31*ga* and is fixed by means of the pin 31*i*, while the first end portion 31*ga* of the rod-shaped member 31*g* is inserted into the guide groove 31*f*.

The pin 31*i* is inserted into a hole portion (not illustrated in the figures) formed in the tip of the first end portion 31*ga* in order to fix the washer 31*h* to the tip portion of the first end portion 31*ga* and thereby prevent the washer 31*h* from coming off.

As illustrated in FIG. 7, the support part 31*j* is fixed to the support frame 22*a* by means of bolts and includes a circular hole portion 31*ja* in which the second end portion 31*gb* of the rod-shaped member 31*g* is inserted. The circular hole portion 31*ja* has an inner diameter greater than the outer diameter of the second end portion 31*gb* of the rod-shaped member 31*g*. The circular hole portion 31*ja* has a clearance whereby the first end portion 31*ga* of the rod-shaped member 31*g* can be vertically moved (i.e., a predetermined clearance). Accordingly, while the oil cooler 23 is opened to a position at the maximum opening angle, the first end portion 31*ga* of the rod-shaped member 31*g* can freely fall from the point X2 to the point X3 within the guide groove 31*f* without being constrained towards the second end portion 31*gb* as the rotary axis.

Opening/Closing Mechanism 32 of Air Conditioner Condenser 25

Figure 11:
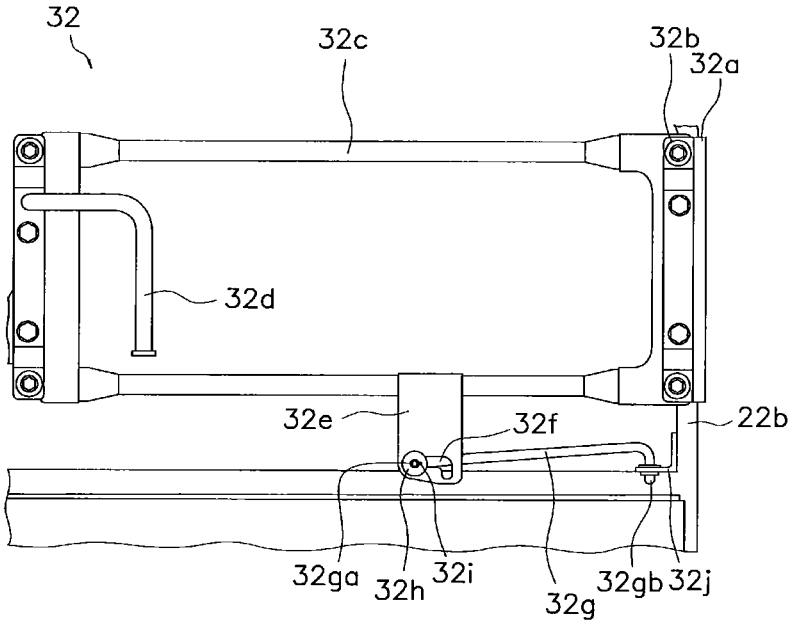
FIG. 11 is a front view of the structure of an opening/closing mechanism of an air conditioner condenser included in the cooling device of FIG. 3.

As illustrated in FIG. 11, the opening/closing mechanism 32 for pivoting the air conditioner condenser 25 is configured to pivot the air conditioner condenser 25 to a position at a predetermined opening angle about a pivot shaft 32*a* disposed in the vicinity of the right end of the front surface of the air conditioner condenser 25.

The opening/closing mechanism 32 includes a rotary shaft 32*a*, an attachment part 32*b*, main body frame 32*c*, a handle 32*d*, a plate member 32*e*, a guide groove 32*f*, a rod-shaped member 32*g*, a washer 32*h*, a pin 32*i* and a support part 32*j*.

As illustrated in FIG. 11, the rotary shaft 32*a* is a pivot center in pivoting the air conditioner condenser 25. The rotary shaft 32*a* is disposed in the vicinity of the right end of the air conditioner condenser 25. It should be noted that the rotary shaft 32*a* is different from the aforementioned pivot shaft 31*a* of the opening/closing mechanism 31 in that the rotary shaft 32*a* is attached to the main body frame 32*c* in parallel thereto without being slanted with respect thereto. Therefore, when being gradually opened from the closed state, the air conditioner condenser 25 is gradually pivoted in the front surface direction without changing the orientation thereof.

As illustrated in FIG. 11, the attachment part 32*b* is fixed to the main body frame 32*c* by means of bolts. Further, the attachment part 32*b* is coupled to the support frame 22*a* of the radiator 22 through the pivot shaft 32*a* and a bracket 22*b*.

As illustrated in FIG. 11, the main body frame 32*c* is a roughly rectangular annular frame to be attached to the rear surface side of the air conditioner condenser 25. The main body frame 32*c* is configured to pivot about the pivot shaft 32*a* together with the air conditioner condenser 25. The main body frame 32*c* is disposed obliquely with respect to a roughly vertical direction. Accordingly, the air conditioner condenser 25 can be obliquely disposed along the angle of the grill 11*a* together with the after-cooler 24 disposed adjacently to and on the rear surface side of the air conditioner condenser 25.

As illustrated in FIG. 11, the handle 32*d* is a part to be held in pivoting the air conditioner condenser 25. The handle 32*d* is disposed on an end, oppositely to the pivot shaft 32*a*, of the main body frame 32*c*.

As illustrated in FIG. 11, the plate member 32*e* is disposed in a position slightly rightwards of the center part of the bottom side of the main body frame 32*c* having a roughly rectangular annular shape while being downwardly protruded therefrom. The plate member 32*e* includes the guide groove 32*f* in the center part thereof.

As illustrated in FIG. 11, the guide groove 32*f* is a groove penetrating in the back-and-forth direction of the vehicle body 11 and allows a first end portion 32*ga* of the rod-shaped member 32*g* to be inserted and moved therein. The guide groove 32*f* is formed in the plate member 32*e*. Similarly to the aforementioned guide groove 31*f* the guide groove 32*f* includes a groove portion arranged along the horizontal direction and a groove portion arranged along the vertical direction. With the structure, in the process of opening the air conditioner condenser 25, the first end portion 32*ga* of the rod-shaped member 32*g* is gradually moved within and along the guide groove 32*f*. When moved to a predetermined position corresponding to the point X2, the first end portion 32*ga* of the rod-shaped member 32*g* downwardly falls due to gravity acting on the rod-shaped member 32*g* and is held within the groove. As a result, the air conditioner condenser 25 can be restricted from pivoting at a desired maximum opening angle.

As illustrated in FIG. 11, the rod-shaped member 32*g* includes the first end portion 32*ga* and a second end portion 32*gb*. The first end portion 32*ga* is configured to be moved along the guide groove 32*f* while the rod-shaped member 32*g* is pivoted about the second end portion 32*gb* as a pivot axis in conjunction with the pivot of the air conditioner condenser 25. The first end portion 32*ga* is protruded along a roughly horizontal direction in the attached state and is inserted into the guide groove 32*f*. The second end portion 32*gb* is protruded roughly vertically downwards in the attached state. The second end portion 32*gb* functions as a pivot center of the rod-shaped member 32*g* while being supported in the support part 32*j*.

As illustrated in FIG. 11, the washer 32*h* is attached to the tip of the first end portion 32*ga* and is fixed by means of the pin 32*i*, while the first end portion 32*ga* of the rod-shaped member 32*g* is inserted into the guide groove 32*f*.

As illustrated in FIG. 11, the pin 32*i* is inserted into a hole portion (not illustrated in the figures) formed in the tip of the first end portion 32*ga* in order to fix the washer 32*h* to the tip portion of the first end portion 32*ga* and thereby prevent the washer 32*h* from combing off.

As illustrated in FIG. 11, the support part 32*j* is fixed to the bracket 22*b* by means of at least a bolt. The bracket 22*b* is fixed to the support frame 22*a* of the radiator 22 by means of at least a bolt. The support part 32*j* includes a circular hole portion 32*ja* in which the second end portion 32*gb* of the rod-shaped member 32*g* is inserted. The circular hole portion 32*ja* has an inner diameter greater than the outer diameter of the second end portion 32*gb* of the rod-shaped member 32*g*. The circular hole portion 32*ja* has a clearance whereby the first end portion 32*ga* of the rod-shaped member 32*g* can be vertically moved. Accordingly, while the air conditioner condenser 25 is opened to a position at the maximum opening angle, the first end portion 32*ga* of the rod-shaped member 32*g* can freely fall along the shape of the guide groove 32*f* without being constrained towards the second end portion 32*gb* as the rotary axis.

Opening/Closing Step of Oil Cooler 23

Now, a series of steps of opening/closing the oil cooler 23 using the aforementioned opening/closing mechanism 31 will be hereinafter explained with reference to FIGS. 12(*a*) to 12(*h*). It should be noted in the figures to be herein explained that FIGS. 12(*a*), 12(*c*), 12(*e*) and 12(*g*) illustrate the process of opening the oil cooler 23 in the form of a side view while FIGS. 12(*b*), 12(*d*), 12(*f*) and 12(*h*) illustrate that in the form of a front view.

Specifically, in executing maintenance, cleaning and etc. of the radiator 22 in the present exemplary embodiment, an operator pulls the oil cooler 23 of the closed state (i.e., an opening angle of 0 degrees) towards the operator's side while holding the handle 31*d* of the opening/closing mechanism 31. Accordingly; the oil cooler 23 is gradually opened with respect to the radiator 22 as illustrated in FIGS. 12(*a*) and 12(*b*).

Figure 12:
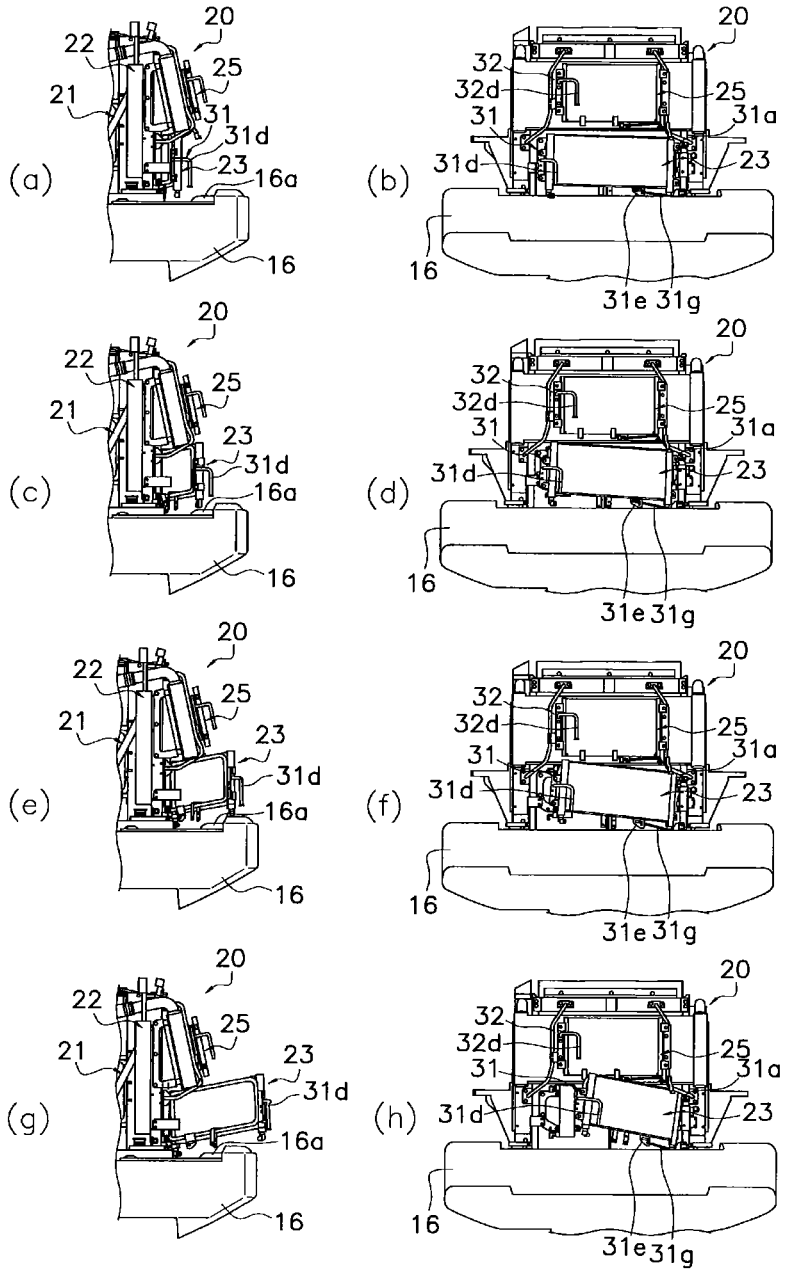
FIG. 12 includes side and front views (a) to (h) illustrating states in gradually opening the oil cooler included in the cooling device of FIG. 3 from a dosed state to positions at angles of 10, 20 and 37 degrees.

Now, when opened to a position at an opening angle of 10 degrees, the oil cooler 23 is gradually moved obliquely upwards in the opening direction as illustrated in FIGS. 12(*c*)

and 12(*d*). This is due to the arrangement of the aforementioned rotary shaft 31*a* of the opening/closing mechanism 31 obliquely disposed with respect to the vertical direction.

When opened to a position at an opening angle of 20 degrees, the oil cooler 23 is moved further obliquely upwards as illustrated in FIGS. 12(*e*) and 12(*f*). Accordingly, the oil cooler 23 can be smoothly opened without causing interference between the oil cooler 23 and the counterweight 16 disposed at the same height level as the bottom end portion of the oil cooler 23 (e.g., the connection portion 23*a*, the pipe 23*b* and etc.) in the closed state.

Subsequently, when opened to a position at an opening angle of roughly 37 degrees as the maximum opening angle, the oil cooler 23 is moved further obliquely upwards while the top end thereof is slanted down and moved to the opening side as illustrated in FIGS. 12(*g*) and 12(*h*). The position of the center of mass of the oil cooler 23 is moved with respect to the rotary shaft 31*a* in accordance with variation in the opening angle. Therefore, a state is produced that the oil cooler 23 is configured to be spontaneously further opened by the weight thereof when the opening angle thereof exceeds a predetermined opening angle.

As described above, the opening/closing mechanism 31 of the oil cooler 23 herein includes the plate member 31*e* (the guide groove 31*f*) and the rod-shaped member 31*g* as a lock mechanism for restricting the pivot of the oil cooler 23. Therefore, the oil cooler 23 can be restricted from being spontaneously further opened by the weight thereof when being pivoted to the position at the maximum opening angle illustrated in FIGS. 12(*g*) and 12(*h*).

Specifically; when the oil cooler 23 is gradually opened to a vicinity of the position at the maximum opening angle, the first end portion 31*ga* of the rod-shaped member 31*g* freely falls from the point X2 and is held in the point X3 within the guide groove 31*f*.

Accordingly, the oil cooler 23 can be locked while being opened to the position at the maximum opening angle. As a result, it is possible to stably and efficiently execute a maintenance work, a cleaning work and etc. of the cooling device 20 including the radiator 22.

It should be noted that the aforementioned lock mechanism is also similarly true of the opening/closing mechanism 32 of the air conditioner condenser 25. Especially, the air conditioner condenser 25 is obliquely disposed with respect to the vertical direction in the closed state as described above. With the structure, the air conditioner condenser 25 is configured to be moved in the closing direction by the weight thereof when an operator releases his/her hold of the handle 32*d*. Therefore, in executing maintenance and etc. of the after-cooler 24, a lock mechanism (the plate member 32*e* (the guide groove 32*f*) and the rod-shaped member 32*g*) may be used in the opening/closing mechanism 32 for preventing the air conditioner condenser 25 from being closed by the weight thereof.

It should be noted that each of the oil cooler 23 and the air conditioner condenser 25 has been exemplified as a component rotating about a rotary shaft disposed on the right side. In the present invention, however, the structures of the oil cooler 23 and the air conditioner condenser 25 are not limited to the above.

For example, each of the oil cooler 23 and the air conditioner condenser 25 may be configured to be rotated about a rotary shaft disposed on the left side.

It should be noted that operability can be enhanced by disposing the rotary shaft of the oil cooler 23 and that of the air conditioner condenser 25 on the same side as the rotary shaft of the grill 11*a* as described in the present exemplary embodiment.

The construction vehicle according to the embodiment can achieve an advantageous effect of avoiding degradation in the cooling efficiency of a heat exchanger, and simultaneously, of avoiding interference of an oil cooler and the other members even in opening/closing the oil cooler for executing maintenance and etc. Therefore, the construction vehicle according to the embodiment is widely applicable to a variety of construction vehicles embedded with a heat exchanger.

The invention claimed is:

1. A construction vehicle comprising:

a vehicle body frame;

a power compartment accommodating an engine mounted on the vehicle body frame;

a cooling compartment disposed rearwards of the power compartment;

a cooling device disposed within the cooling compartment, the cooling device including a plurality of heat exchangers; and a cooling fan disposed within the cooling compartment, the cooling fan being configured to form a cooling wind flow path for inhaling outdoor air and directing the inhaled outdoor air towards the cooling device, wherein the cooling device includes:

a radiator disposed on the vehicle body frame along a roughly vertical direction;

an oil cooler disposed adjacent to the radiator with a rear surface side thereof being arranged to be faced in roughly parallel to a lower part of a front surface of the radiator;

a first opening/closing mechanism including a rotary shaft, the rotary shaft being obliquely disposed with a top end portion thereof being arranged closer to the front surface of the radiator than a bottom end portion thereof is, the opening/closing mechanism being configured to pivot the oil cooler about the rotary shaft and simultaneously move the oil cooler with respect to the radiator;

an after-cooler disposed adjacent to the radiator with a rear surface side thereof being arranged to be faced to an upper part of the front surface of the radiator; and an air conditioner condenser disposed adjacent to the after-cooler with a rear surface side thereof being arranged facing a front surface of the after-cooler, the first opening/closing mechanism being configured to pivot the oil cooler unobstructedly with respect to the after-cooler and the air conditioner condenser between an open position and a closed position, and either a counterweight mounted on a rear part of the vehicle body frame or a part of the vehicle body frame is disposed on a line horizontally extended from a bottom end portion of the oil cooler.

2. The construction vehicle recited in claim 1, wherein the oil cooler and the radiator are disposed in this order from a vehicle body rear end side along a back-and-forth direction of the vehicle body frame.

3. The construction vehicle recited in claim 1, wherein the first opening/closing mechanism further includes:

a support bracket supporting the oil cooler;

a main body frame receiving the oil cooler attached thereto; and an attachment part coupling the main body frame and the support bracket through the rotary shaft.

4. The construction vehicle recited in claim 3, wherein the first opening/closing mechanism further includes:

a plate member fixed to the main body frame, the plate member being disposed in parallel to the roughly vertical direction;

a groove part formed in the plate member, the groove part including a guide groove extended from the roughly horizontal portion in a roughly vertically downward direction; and a rod-shaped member having a first end portion, the first end portion configured to be moved along a shape of the guide groove while being inserted into the groove part, the first end portion configured to fall into and held by the guide groove when the oil cooler is opened to a position at a predetermined angle.

5. The construction vehicle recited in claim 4, wherein the first opening/closing mechanism further includes a circular hole portion, the circular hole portion allowing a second end portion of the rod-shaped member to be pivotably inserted therein through a predetermined clearance, the second end portion being formed oppositely to the first end portion of the rod-shaped member, and the circular hole portion is roughly vertically opened in a support portion attached to the support bracket.

6. The construction vehicle recited in claim 1, wherein the after-cooler at least partially overlapping the oil cooler as viewed along a vertical direction, the first opening/closing mechanism being configured to pivot the oil cooler so as not to interfere with the after-cooler without moving the after-cooler.

7. The construction vehicle recited in claim 4, wherein the rod-shaped member further includes a middle portion and a second end portion, the first end portion protruding from the middle portion and the second end portion protruding from the middle portion in a different direction than the first end portion.

8. The construction vehicle recited in claim 7, wherein the first end portion protrudes in a roughly horizontal direction; and the second end portion protrudes in the roughly vertical direction.

9. The construction vehicle recited in claim 6, wherein the after-cooler is arranged obliquely with respect to the radiator such that an upper portion of the after-cooler is closer to the radiator than a lower portion of the after-cooler.

10. The construction vehicle recited in claim 1, wherein the bottom end portion of the oil cooler is disposed at a position lower than a bottom end portion of any other heat exchanger of the cooling device.

11. The construction vehicle recited in claim 1, wherein the air conditioner condenser is supported on another a second open/closing mechanism configured to pivot the air conditioner condenser away from the after-cooler about a generally vertical axis, the first opening/closing mechanism and the second opening closing mechanism having pivot axes that are substantially parallel to each other.

12. The construction vehicle recited in claim 10, wherein the air conditioner condenser being supported on a second open/closing mechanism configured to pivot the air conditioner condenser away from the after-cooler about a generally vertical axis, and the first opening/closing mechanism being configured to pivot the oil cooler unobstructedly with respect to the after-cooler and unobstructedly with respect to the air conditioner condenser at least when the air conditioner condenser is pivoted away from the after-cooler.

* * * * *